US005329082A

United States Patent [19]

Saarem

[11] Patent Number: 5,329,082

[45] Date of Patent: Jul. 12, 1994

[54] IRRIGATION SYSTEM TIMER CONTROL

[75] Inventor: Myrl J. Saarem, Carson City, Nev.

[73] Assignee: James Hardie Irrigation, Laguna Niguel, Calif.

[21] Appl. No.: 977,139

[22] Filed: Nov. 16, 1992

Related U.S. Application Data

[63] Continuation of Ser. No. 797,048, Nov. 25, 1991, abandoned.

[51] Int. Cl.[5] ..... H01H 43/10

[52] U.S. Cl. ..... 200/38 D; 200/38 DA; 200/38 DB

[58] Field of Search ..... 200/35 R, 37 R, 37 A, 200/38 R, 38 D, 38 DA, 38 DB, 38 DC; 307/141, 141.4, 141.8

[56] References Cited

U.S. PATENT DOCUMENTS

| | | | |
|---|---|---|---|
| Re. 25,805 | 6/1965 | Gould | 307/141 |
| 3,598,936 | 8/1971 | Saarem et al. | 200/18 |
| 3,734,869 | 5/1973 | Menard et al. | 200/11 R |
| 4,097,763 | 6/1978 | Saarem | 307/141 |

*Primary Examiner*—J. R. Scott

*Attorney, Agent, or Firm*—Keith D. Becher

[57] ABSTRACT

An electric controller for selectively activating a plurality of solenoid water valves in a irrigation system and on a pre-selected recurrent time basis. The controller features a molded chassis and a printed circuit board construction to provide a more rugged and simplified unit as compared with the prior art controllers of the same general type.

5 Claims, 4 Drawing Sheets

IRRIGATION SYSTEM TIMER CONTROL

This is a continuation of application Ser. No. 07/797,048, filed Nov. 25, 1991, now abandoned.

BACKGROUND OF THE INVENTION

U.S. Pat. No. 3,101,418 provides an electric controller for controlling electrically-operated valves of an irrigation system. The controller described in the patent is relatively easy to install and easy to set to the specific program desired for any particular irrigation system.

An objective of the present invention is to provide a controller of the same general type as described in the patent, but one which is simpler and more rugged in its construction, and one which is more reliable and more capable of long term trouble free operation. Like the unit described in the patent, the controller of the present invention is easy to install, and easy to set to any specific program desired for any particular irrigation system.

SUMMARY OF THE INVENTION

An electric controller for selectively activating a number of solenoid water valves in an irrigation system is provided. The controller of the invention has the ability of activating the solenoid valves of the irrigation system on a preselected recurring time basis. The controller features a molded chassis and printed circuit board constructed to provide a more rugged and simplified unit as compared with the prior art controllers of the same general type.

DETAILED DESCRIPTION OF THE INVENTION

Figure 1:
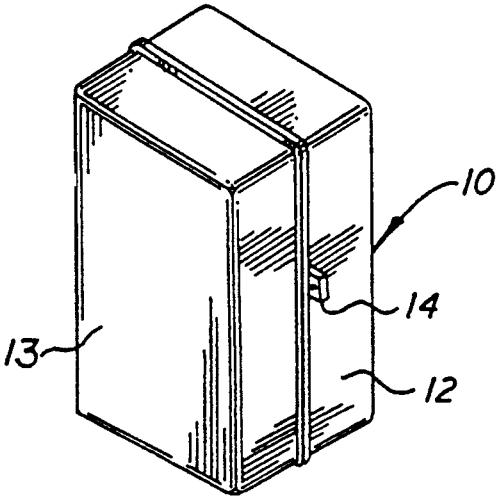
FIG. 1 is a perspective view of the housing of one embodiment of the irrigation controller of the invention.

The controller of the invention may be enclosed in a housing 10, shown in FIG. 1. The housing 10 includes two sections 12, 13 which are hinged together, the sections being held closed by conventional fasteners 14. Section 12 houses the various components of the controller, and section 13 serves as a cover.

Figure 2:
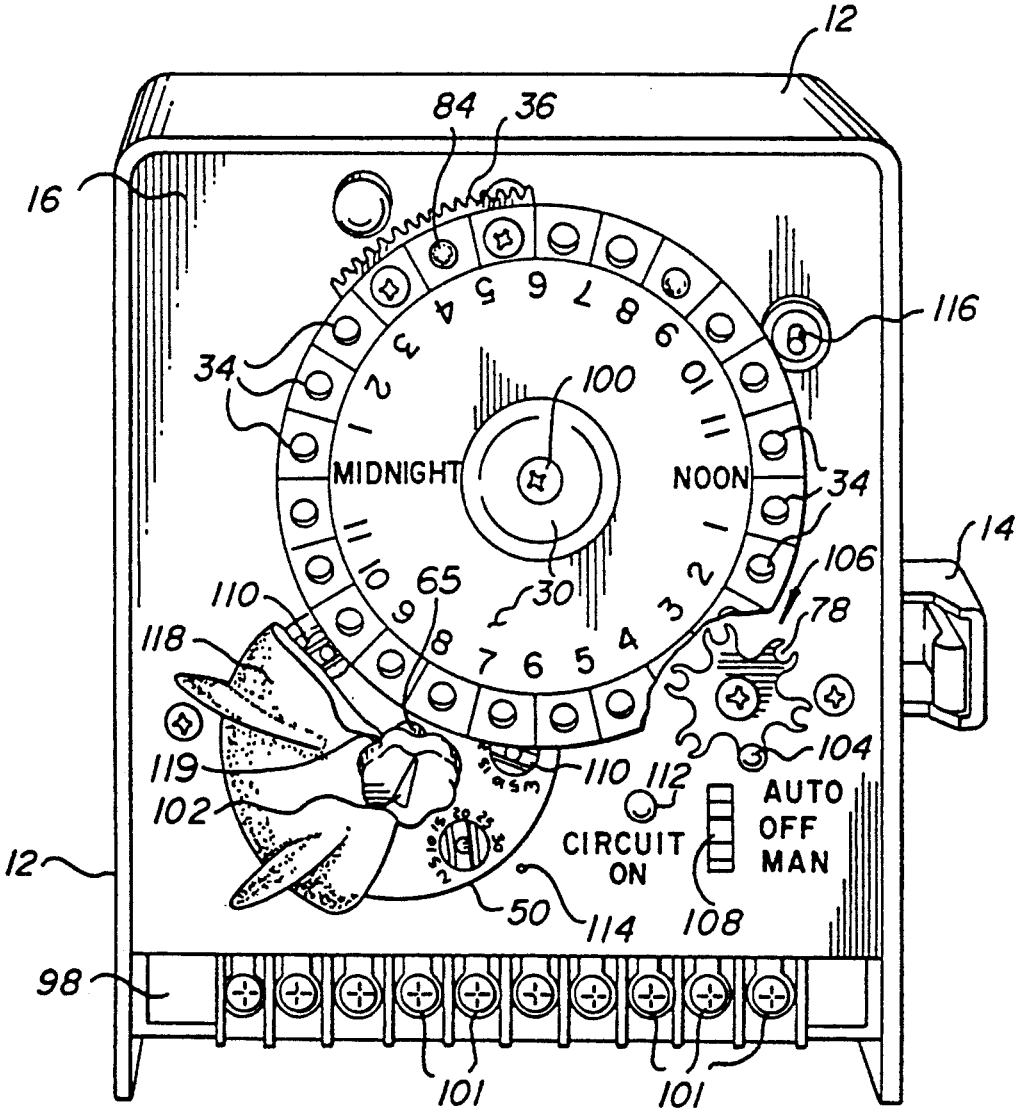
FIG. 2 is a view of the irrigation controller of FIG. 1, with the cover of the housing removed to reveal the operating controls of the controller.
Figure 3:
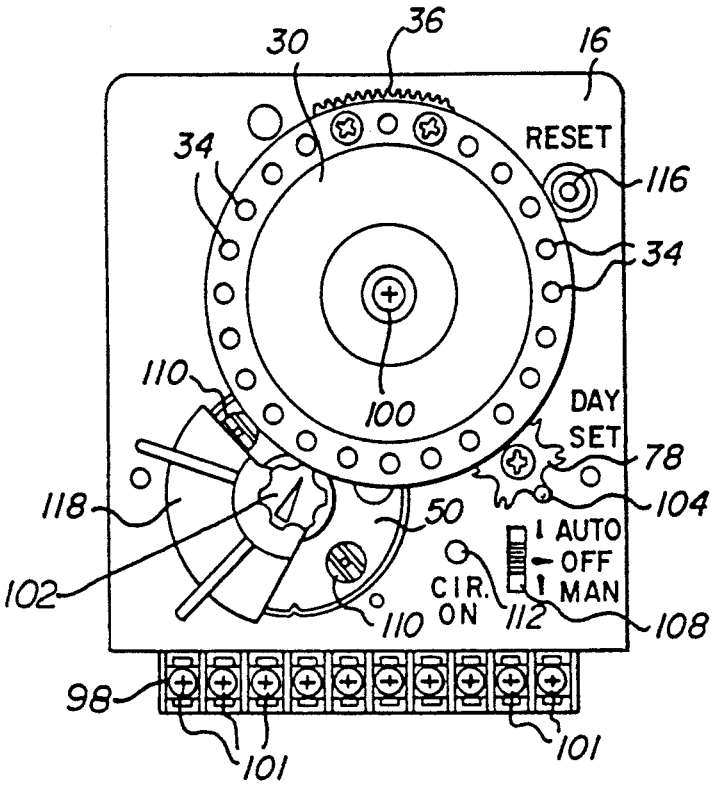
FIG. 3 is a view, like FIG. 2, of the controller of FIG. 1, but removed from the housing.
Figure 4:
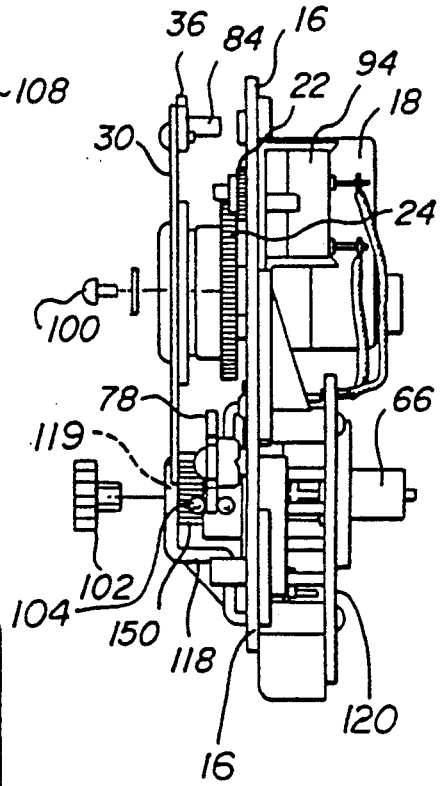
FIG. 4 is a side view of the controller of FIG. 3.
Figure 5:
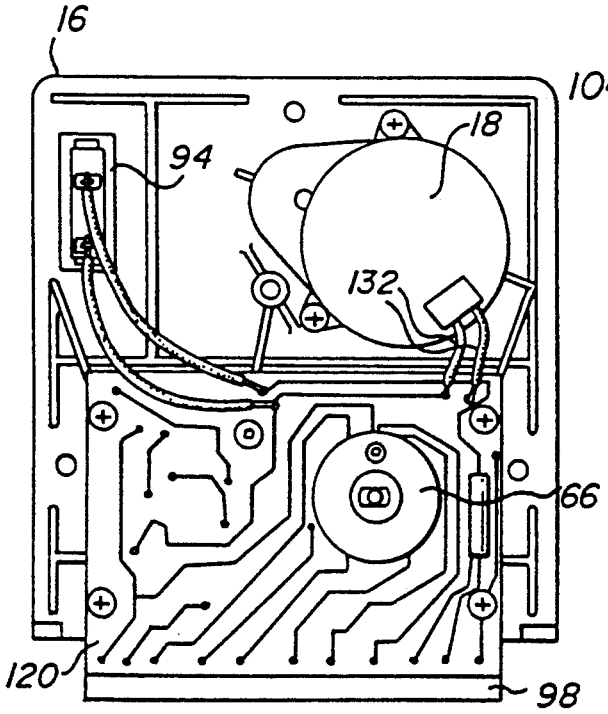
FIG. 5 is a back view of the controller of FIG. 3.
Figure 6:
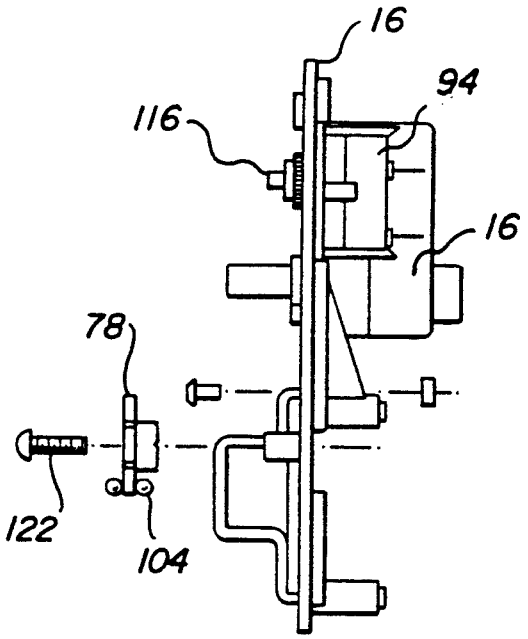
FIG. 6 is a further side view of the controller of FIG. 3 with an internal circuit board assembly removed.

A plastic plate 16 is mounted in section 12, shown in FIG. 2, and the plate supports a conventional clock motor 18, shown in FIGS. 4 and 5. The clock motor drives a gear 22 (FIG. 4) which, in turn, drives a larger gear 24. A time dial 30 is attached to gear 24 in coaxial relationship with the gear. The dial is held in place by a screw 100. Time dial 30 is driven by motor 18 in a counter-clockwise direction as viewed FIGS. 2 and 3. A slip clutch (not shown) is interposed between gear 24 and time dial 30 to permit the dial to be rotated by hand in a counter-clockwise direction to permit the dial to be set to a desired time position when the controller is being installed or adjusted.

As shown in FIG. 2, time dial 30 carries a number of indicia corresponding to conventional hour markings on a 24 hour clock. Time dial 30 is also provided with a number of equiangularly spaced holes 34 located around its periphery. These holes correspond in spacing to various desired time periods with respect to the hour indicia located on dial 30.

Holes 34 are provided so that a segmental tripper gear 36 may be mounted on time dial 30 at any desired location around its periphery. The segmental tripper gear 36 is secured to the time dial 30 by appropriate screws, and it is securely held on the dial so that it is rotated as dial is rotated. If so desired, several segmental gears of the same lengths, corresponding to gear 36, may be mounted around the perimeter of time dial 30.

A rotary switch 66 is rotatably mounted on the back of plate 16 (FIGS. 4 and 5), and a drive shaft 65 (FIG. 2) for the moveable contact of the rotary switch extends through plate 16. A gear 150 is mounted on the drive shaft 65 in position to be engaged by the segmental gear 36 during rotation of time dial 30 to cause rotation of the moveable contact of rotary switch 66. The segmental gear 36 and gear 150 are designed so that the moveable contact of switch 66 makes one complete revolution each time gear 150 is engaged by segmental gear 36.

Figure 10:
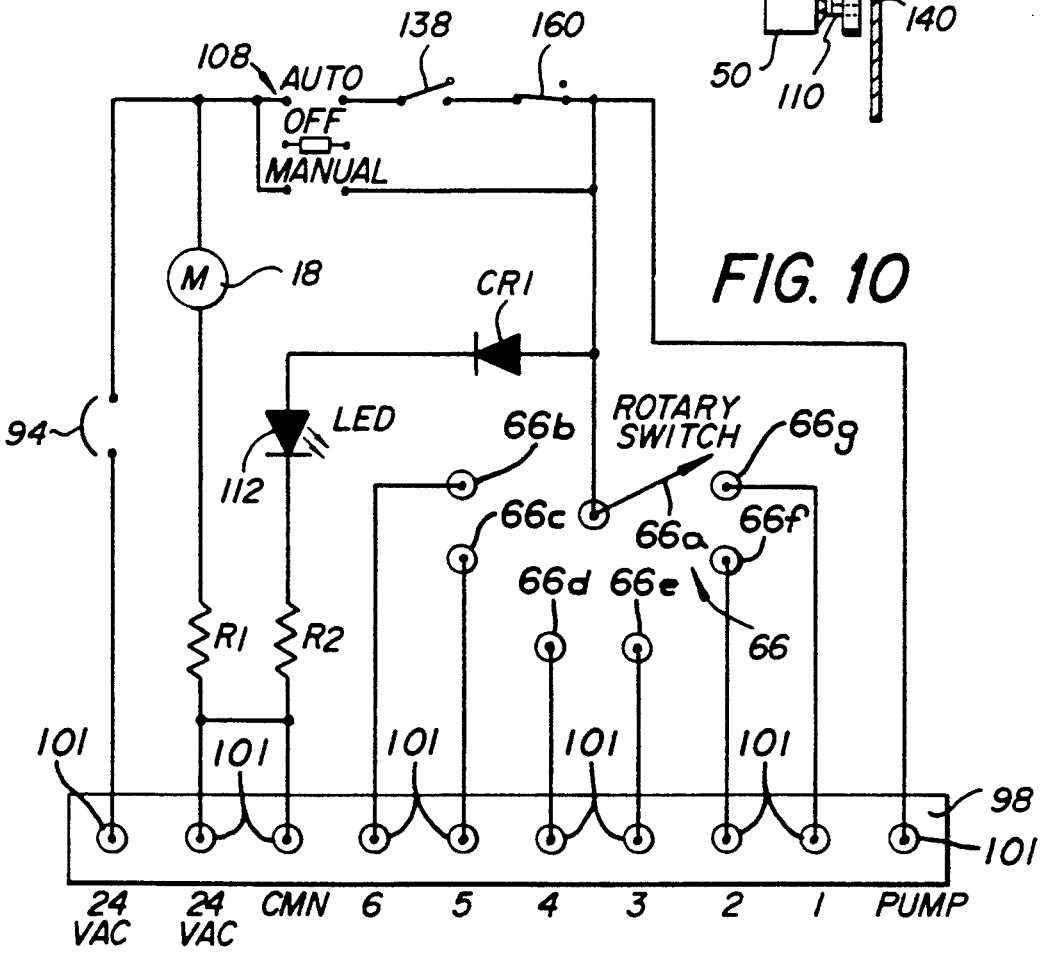
FIG. 10 is circuit diagram of the electric connections of the controller.

The rotary switch 66 is shown schematically in FIG. 10, in which the moveable contact is designated 66*a*, and the rotary switch is illustrated as having six fixed contacts 66*b*–66*g*. As stated above, each time gear 150 is engaged by segmental gear 36 during rotation of time dial 30, the moveable contact 66 makes a complete revolution, and in so doing successively engages the six fixed contacts 66*b*–66*g*.

Figure 8:
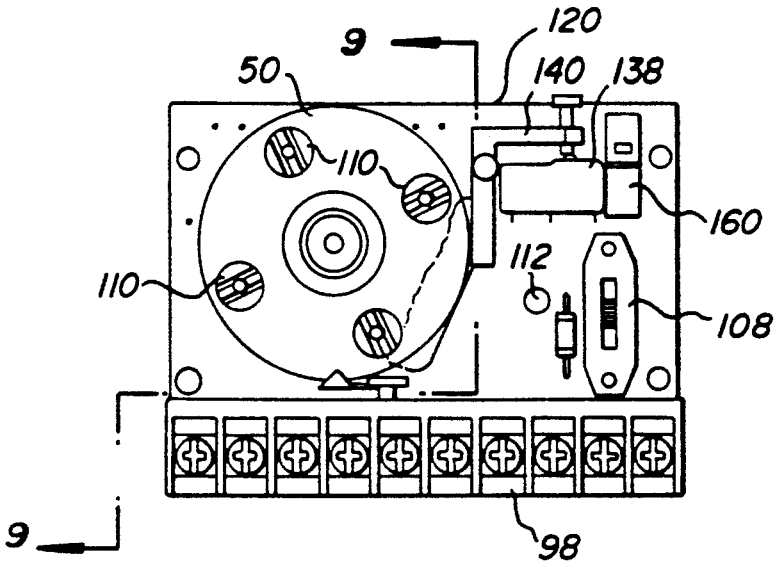
FIG. 8 is a top view of the internal circuit board assembly referred to above.
Figure 9:
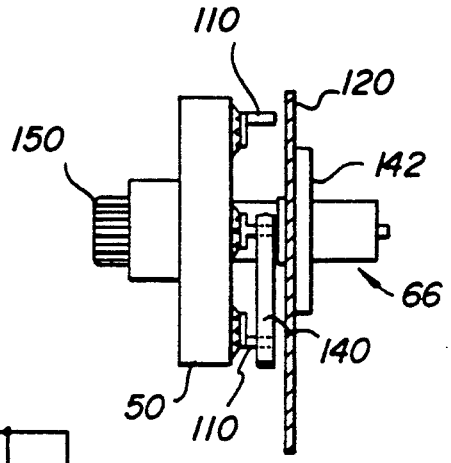
FIG. 9 is a section taken along the line 9—9 of FIG. 8.

As best shown in FIGS. 8 and 9, a disc 50 is coaxially mounted on the drive shaft 65 of rotary switch 66, and the disk 50 is contained in an opening in plate 16 to be accessible from the front of plate 16, as shown in FIG. 3. The plurality of cams 110 are rotatably mounted in disk 50 at equiangular positions around the disk, and these cams each include a pin-like portion which extends from the rear of disk 50. The cams are individually rotatable from the front of plate 16 to respective predetermined angular positions. Although only four cams are shown in FIG. 8, six would be used in the embodiment under consideration.

A printed circuit board 120 (FIGS. 5 and 9) is mounted on the rear side of plate 16 in spaced and parallel relationship with the plate. The drive shaft of rotary switch 66 extends through the printed circuit board 120. A push button switch 138 (FIG. 8) is mounted on the printed circuit board 120, and an actuator 140 for switch 138 is pivotally mounted on the printed circuit board adjacent to the switch, as also shown in FIG. 8. The actuator 140 is in position to be engaged successively by the pin portions of cams 110, as disk 150 is rotated. Each of the cams 110 may be adjusted to a desired angular position from the front of plate 16 (FIG. 3) to determine, in each instance, how long switch 138 will be turned on by actuator 140 as disk 150 is rotated by segmental gear 36.

A further disk 142 is mounted on the drive shaft 65 of rotary switch 66 behind the printed circuit board 120, and disk 142 supports the moveable contact 66*a* (FIG. 10) of switch 66 which successively engages the fixed contacts 66*b*–66*g* as disk 142 is rotated. The fixed contacts 66*b*–66*g* are part of the printed circuit on printed circuit board 120.

As shown in FIGS. 2, 3 and 4, a molded plastic shroud 118 is formed integral with plastic plate 16 to provide a positive bearing support for the drive shaft 65 of rotary switch 66 at the upper end of the drive shaft 65 which extends into an aperture 119 in the shroud (FIG. 2). A zone selector knob 102 is mounted on the top end of the drive shaft to permit manual rotation of the switch.

Figure 7:
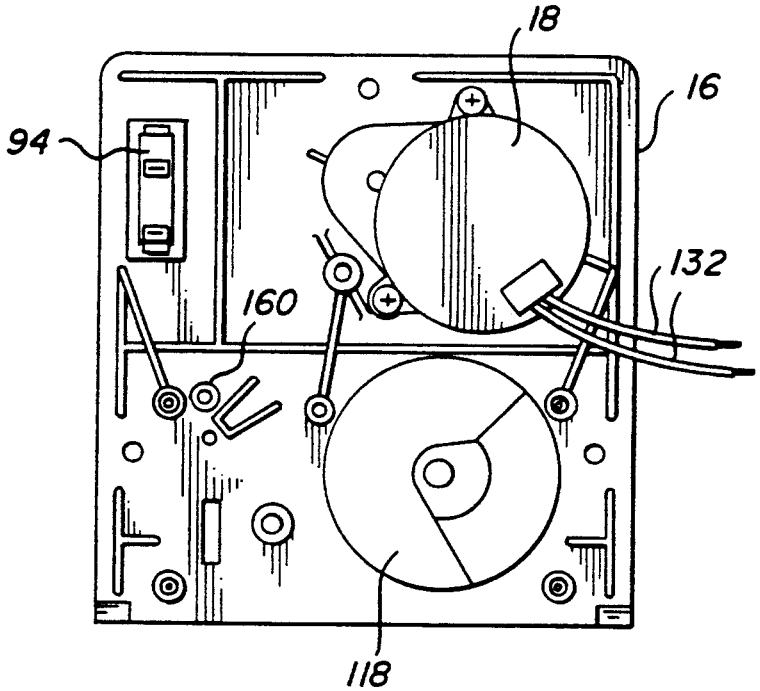
FIG. 7 is a back view of the controller shown in FIG. 6.

A Geneva-like wheel 78 with radial arms is rotatably mounted on plate 16 (FIGS. 2, 3 and 4). Wheel 78 is adapted to rotate a fraction of a turn for each full rotation of time dial 30. This is achieved by engagement of the wheel by a pin 84 mounted on the time dial (FIG. 2). The wheel 78 carries one or more dependent pins 104 (FIGS. 2, 3 and 4) which may be inserted into sockets at the ends of its radial arms. A normally closed push-button switch 160 (FIGS. 7 and 8) mounted on circuit board 120 is positioned under plate 16 so as to be engaged successively by pins 104 to open the circuit of FIG. 10 whenever it is so engaged.

The system also includes a circuit breaker 94 (FIGS. 4, 5 and 9) for safety purposes. The circuit breaker may be reset by a push button 116 (FIGS. 2 and 3). The controller also includes a terminal strip 98 (FIGS. 3, 5 and 10) mounted on one edge of the circuit board 120. A number of screw terminals 101 (FIG. 3) are mounted on the terminal strip 98 to connect the controller to the power source and to various solenoid valves in the irrigation system, as will be described with reference to FIG. 10. A slide switch 108 (FIGS. 2 and 3) is mounted on plate 16 to enable the controller to be set manually to "off", "manual", or "automatic." A light emitting diode (LED) 112 is mounted on the panel to indicate when the controller is supplying power to the valve terminals.

The electric connections of the controller are shown in FIG. 10. As shown, the fixed contacts 66*b*–66*g* of the rotary switch 66 are connected by the printed circuit on the circuit board to terminal screws 1–6 of terminal strip 99 (also designated 101). A 24-volt AC power supply is connected to three of the terminal screws 101 to the left of the terminal board, and the right hand terminal screw of the terminal board 98 may be connected to a pump.

The left hand terminal screw 101 is connected through the circuit breaker 94 to slide switch 108, and to one terminal of motor 18. The other terminal of motor 18 is connected to the next terminal screw through a resistor R-1. The second terminal screw is connected to a common terminal screw, and through a resistor R-2 to the light emitting diode 112 which, in turn, is connected through a diode CR1 to the moveable contact 66*a* of the rotary switch. The "AUTOMATIC" terminal of switch 108 is connected through switch 138, and through the normally closed push-button switch 160, to the moveable contact 66*a*, and also through the right hand terminal screw 101 to the pump. The "MANUAL" contact of switch 108 is directly connected to the moveable contact 66*a* of the rotary switch.

When the circuit breaker 94 is closed, and the 24-VAC terminals are connected to an appropriate power supply, the motor 18 is energized. Then, if slide switch 108 is set to "MANUAL", the controller is rendered operational. At that time, the moveable contact 66*a* of the rotary switch may be manually turned from one fixed contact to another so that the solenoid valve sprinklers connected to terminals 1–6 may be successively energized.

A selector knob 102 (FIGS. 2 and 4) is mounted on the upper end of the drive shaft of rotary switch 66 to enable the switch to be turned manually from one fixed contact (FIG. 2) to next. This permits manual selection of the particular solenoid controlled sprinkler which is to be energized.

When the slide switch 108 is set to "OFF" the system is de-energized. When the slide switch 108 is set to "AUTO", the system is energized only when timing switch 138 is closed. Accordingly, the movable contact 66*a* of rotary switch 66 is then moved from one fixed contact to the next by the individual cams 110 on disk 50, and each solenoid valve of the different sprinklers is energized for a period determined by the settings of the cams 110. Also, for each interval when the push-button switch 160 is actuated, the system becomes de-energized to correspond to a "skip-a-day" condition.

OPERATING INSTRUCTIONS FOR ILLUSTRATED EMBODIMENT

Step 1: Set the Current Time of Day

A. The zone selector knob 102 is turned to a detent (locked) position with the arrow inscribed on the knob (FIG. 2) pointing at the screw 100 in the center of the time dial 30.

B. The time dial 30 is turned counter-clockwise until the current time of day is next to the arrow on the selector knob.

Step 2: Set the Watering Days Schedule

The controller may be provided with two skip-a-day wheels 78, namely a 6-spoke wheel for watering by day intervals, and a 7-spoke wheel for watering by days of the week.

A. Watering by day intervals using the 6-spoke wheel, skip-a-day pins 104 are placed in the spokes of the wheel 78 for the days that watering is not desired.

B. Watering by days of the week using the 7-spoke wheel, skip-a-day pins are placed the spokes of wheel 78 for the days of the week that watering is not desired.

C. After inserting the pins, the skip-a-day wheel 78 is turned clockwise until the spoke representing "to-day" is over push-button switch 160.

When a skip-a-day pin engages the push-button switch 160, it will prevent watering.

Step 3: Set the Watering Start Time

The segmental tripper gear 36 determines the time of day watering will occur. To change the location of the stripper gear, the two screws holding the gear to the time dial are loosened, and the gear is moved around the dial to correspond to the time of day watering is to occur. If watering is to occur more than once a day, a repeat tripper gear may also be mounted on the time dial.

Step 4: Set the Run Time for Each Zone

Zone running times can be individually adjusted to meet the needs of each watering area, for example, from five minutes to 45 minutes.

A. Slide switch 108 is moved to "off". The zone selector knob 102 is turned to display each zone timing cam 110 in succession. The exposed timing cam is turned by placing a screwdriver in the timing cam slot to align a small arrow with the running time desired.

B. After the run times are set, the selector knob 102 is returned to the detent position with the arrow pointing at the screw in the center of the time dial 30. The zone selector knob will lock into position.

C. The slide switch 108 is then moved to "AUTO".

Step 5: Manual Watering

A. The slide switch 108 is moved to "off". The zone selector knob 102 is turned until a number (not shown) on disk 50 corresponding to a selected zone aligns with dot 114 on the chassis. The slide switch is moved to "manual". The LED 112 will turn on to indicate that the selected zone is in operation.

B. Following manual operation, the zone selector knob 102 must be returned to its detent position with its arrow pointing at the screw in the center of the time dial 30. The slide switch 108 is then returned to the "AUTO" or "OFF" position.

SYSTEM 8HUT-OFF

To prevent watering, the slide switch 108 is moved to "OFF". The clock will continue to keep time but will not operate the valves of the Irrigation System.

CIRCUIT BREAKER PROTECTION

A tripped circuit breaker 94 indicates an electric problem in the valve wiring connection or solenoid. If the circuit breaker trips, the zone selector disk 50 will stop at the problem zone. After repairs, the push-button 116 is activated to reset the circuit breaker.

The invention provides, therefore, an improved irrigation system controller which is relatively inexpensive to construct, and which is rugged and reliable. The controller is relatively easy to adjust, and simple to operate.

It will be appreciated that while a particular embodiment of the invention has been shown and described, modifications may be made. It is intended in the claims to cover all modifications which come within the true spirit and scope of the invention.

I claim:

1. An electric controller including: a housing; a mounting plate extending across said housing and dividing said housing into a forward compartment and a rear compartment; an electric motor mounted on the rear side of said mounting plate to be positioned in said rear compartment and having a drive shaft extending through said mounting plate; a time dial coupled to said drive shaft to be rotated thereby, said time dial being positioned on the forward side of said mounting plate in said forward compartment; a gear segment attached to the peripheral edge of said time dial; a printed circuit board mounted on the rear side of said mounting plate and positioned in said rear compartment; a terminal strip mounted on one edge of said printed circuit board having a plurality of electric terminals mounted thereon; a plurality of printed circuit conductors formed on said printed circuit board respectively connected to said electric terminals on said terminal strip and extending from said terminal strip to establish electric contact with respective ones of said electric terminals; a rotary distribution switch mounted on the rear side of said mounting plate adjacent to said printed circuit board and having a drive shaft extending through said mounting plate; a gear coaxially mounted on said rotary switch drive shaft in position to be engaged by said gear segment and to be rotated thereby during a predetermined portion of each rotation of said time dial; said printed circuit conductors extending from said terminal strip and defining a corresponding plurality of fixed contacts for said rotary switch at the respective distal ends thereof arranged in a circle and connected through said printed circuit conductors to respective ones of said terminals on said terminal strip, said rotary distribution switch having a movable contact member mounted on said rotary switch drive shaft to be rotated thereby and positioned to engage said fixed contact successively on said printed circuit board as said distribution is rotated.

2. The electric controller defined in claim 1, and which includes a knob mounted on the end of said rotary switch drive shaft in said forward compartment to enable said movable contact to be turned manually from one of the fixed contacts to another of the fixed contracts.

3. The electric controller defined in claim 1, in which said mounting plate is formed of plastic material, and which includes a molded plastic shroud formed integral with said mounting plate on the forward side thereof, and positioned in said forward compartment, and said shroud having an aperture therein for receiving said rotary switch drive shaft to provide a positive bearing support for the forward end of said rotary switch drive shaft.

4. The electric controller defined in claim 1, and which includes a disc mounted on said rotary switch drive shaft and positioned in an opening in said mounting plate to be accessible from the front of the said mounting plate; a plurality of cam members rotatably mounted in said disc at equiangular positions around said disc and extending through said disc, said cam members being individually adjustable to predetermined angular positions; a normally-open push-button switch mounted on the forward side of said printed circuit board, and an actuator for said push-button switch mounted on the forward side of said printed circuit board adjacent to said push-button switch and in position to be engaged successively by said cams as said distribution switch is rotated from one of said fixed contacts to another of said fixed contacts, and each of said cams determining how long push-button switch is turned on for each engagement of individual ones of said fixed contacts by said movable contact.

5. The electric controller defined in claim 1, and which includes a skip-a-day wheel mounted on the forward side of said mounting plate in a position to be engaged by a pin mounted on the time dial to be rotated a fraction of a turn for each full rotation of said time dial, and at least one pin mounted on said wheel to be moved from one angular position to another angular position for each fraction of a turn rotation of said wheel; and a normally-closed push-button switch mounted on said mounting plate in position to be engaged and actuated by said pin on said wheel for each of said angular positions of said pin.

* * * * *